US005727704A

United States Patent [19]

Glynn

[11] Patent Number: 5,727,704

[45] Date of Patent: Mar. 17, 1998

[54] CHILD RESISTANT CAP AND SAFETY COLLAR RING HAVING UNIQUE BOSS ARRANGEMENTS

[75] Inventor: Kenneth P. Glynn, Raritan Township, Hunterdon County, N.J.

[73] Assignee: Ideal Ideas, Inc., Flemington, N.J.

[21] Appl. No.: 685,095

[22] Filed: Jul. 23, 1996

[51] Int. Cl.[6] ..... B65D 50/10

[52] U.S. Cl. ..... 215/223; 215/221; 215/225; 215/332

[58] Field of Search ..... 215/206, 204, 215/208, 211, 213, 214, 217, 219, 221, 223, 224, 225, 273, 274, 295, 303, 304, 321, 343, 344, DIG. 1, 330, 332; 220/293, 296, 297

[56] References Cited

U.S. PATENT DOCUMENTS

| | | | |
|---|---|---|---|
| 3,450,290 | 6/1969 | Turner . | |
| 3,693,820 | 9/1972 | Linkletter . | |
| 3,703,974 | 11/1972 | Boxer et al. . | |
| 3,782,578 | 1/1974 | Ballin . | |
| 4,095,718 | 6/1978 | Kong . | |
| 4,121,727 | 10/1978 | Robbins et al. . | |
| 4,361,243 | 11/1982 | Virtanen . | |
| 4,399,921 | 8/1983 | Kusz . | |
| 5,316,162 | 5/1994 | Pierson . | |
| 5,317,796 | 6/1994 | Hunter | 215/223 X |
| 5,397,008 | 3/1995 | Glynn . | |
| 5,462,181 | 10/1995 | Glynn | 215/206 X |
| 5,520,305 | 5/1996 | Pierson | 215/206 X |
| 5,593,054 | 1/1997 | Glynn | 215/206 X |

*Primary Examiner*—Allan N. Shoap
*Assistant Examiner*—Nathan Newhouse
*Attorney, Agent, or Firm*—Kenneth P. Glynn, Esq.

[57] ABSTRACT

The present invention is a container closure device, which includes a container, a collar ring and a cap. The container has a neck, an open top and a horizontal retainer track thereon for affixing a collar ring thereto. A collar ring affixed to a track of the container has a plurality of cut outs on a ledge to permit a cap to be inserted and removed from the collar ring. The cap has has a plurality of bosses which correspond to and are sized to freely move through the cut outs of the ledge of the collar ring and, when the cap is so inserted and rotated, of adequate size to cause frictional engagement and to cause simultaneous rotation of the cap and the collar ring and to prevent removal of the cap from the collar ring, except when the cap and the collar ring are held separately and are rotated relative to one another such that the bosses and the cut outs are in alignment for lift up removal of the cap from the collar ring. Corresponding bosses and cut outs have different lengths and depths so that one boss cannot slip through a non matched cut out.

20 Claims, 3 Drawing Sheets

CHILD RESISTANT CAP AND SAFETY COLLAR RING HAVING UNIQUE BOSS ARRANGEMENTS

BACKGROUND OF THE INVENTION

1. Field of the Invention

The present invention relates to child resistant caps, and more particularly to single caps with safety rings for tubes, bottles and other capped containers.

2. Information Disclosure Statement

Safety caps have been well known for at least three decades and literally come in many hundreds of shapes and forms with diverse mechanisms for achieving safety. The objective of such devices is to slow down or prevent the opening of a dispenser by a child to ultimately reduce or prevent use of a medication or dangerous or hazardous material by a young child who may unwittingly consume some of the contents and suffer severe consequences. The following patents represent four variations on safety caps which exemplify the art:

U.S. Pat. No. 3,703,974 to Leo Boxer and Robert Boxer describes a safety cap and container combination wherein the container mouth includes a plurality of spaced ribs or flanges, each having a differently located, notched out passageway over which a cap member having at least one projecting internal lug is positioned in a single movement to close the container. In one form of the invention, a bead at the rim of the container mouth may be provided to mate with an internal groove in the cap member to seal tightly the cap member to the container. In order to remove the cap member, it is moved partially away from the container to disengage the bead from the groove and the lug member is then positioned and aligned with each slot and advanced therethrough in successive fashion to open the mouth of the container.

U.S. Pat. No. 3,782,578 to Gene Ballin sets forth a novel disposable closure. The device includes an opener for opening a closure cap along a score line around the base of an annular channel without piercing the cap. It includes a collar which rotatably and slidably engages the cap and includes a peripheral wall provided with circumferentially spaced depending arcuate teeth of greater thickness than the channel and stop elements which limit the downward movement of the device on the cap. The device is pressed downwardly and rotated so that the teeth wedge between and spread the channel walls to sever the closure along the full length of the score line. The piercing of the channel by the teeth is prevented by the stop elements.

U.S. Pat. No. 4,095,718 to Cheung Tung Kong describes a convertible safety cap. A cap is provided for closing a container having a locking portion for use in a precautionary arrangement to prevent children from obtaining access into the container. The cap is convertible so as to cooperate with such a container to provide not only such a precautionary arrangement but also an alternative easy opening arrangement. The invention includes a cap, an annular disk and a locking rim with notches through which tabs on the cap may pass.

U.S. Pat. No. 4,361,243 to Risto Virtinen describes a closing means for a container, tube or the like. This device is a closing means for a nozzle which is fixably mounting on a container or for a tube or the like. The closing means is openable when turned into a predetermined position which is indicated by indicators provided on the closing means and on the container. It is settable diametrically opposite to each other, and characterized in that the lower rim of the closing means or the upper rim of the container is provided with a separate background ring extending at least partially behind the indicator of the closing means and the indicator of the container.

U.S. Pat. No. 5,397,008 to Kenneth P. Glynn, the same inventor herein, discloses a container and closure device which includes the container, a collar ring and a cap. There is at least one of protrusion in the cap which, when aligned with at least one cut out in the collar ring, allow for removal of the cap but, when unaligned, removal of the cap is prevented. This invention does not disclose the unique geometry of the bosses and cut outs of the present invention.

Notwithstanding the significant prior art in this field, it is believed that the present invention, which utilizes a safety collar (outer ring) in the particular fashion described herein, is neither taught nor rendered obvious.

SUMMARY OF THE INVENTION

The present invention is a container closure device, which includes a container, a collar ring and a cap. The container has a neck, an open top and a horizontal retainer track thereon for affixing a collar ring thereto. The collar ring has a circular inside wall with a horizontal track thereon for attachment to the track of the container so as to be horizontally and freely rotatable thereabout. The collar ring also has a top with a ledge thereon for frictionally engaging and retaining a cap, and has a plurality of cut outs on the ledge to permit a cap to be inserted and removed from the collar ring. The cap has semi-flexible walls and has a plurality of bosses which correspond to and have a geometry of adequate size to freely move through the cut outs of the ledge of the collar ring and, when the cap is so inserted and rotated, of adequate size and geometry to cause frictional engagement and to cause simultaneous rotation of the cap and the collar ring and to prevent removal of the cap from the collar ring, except when the cap and the collar ring are held separately and are rotated relative to one another such that the bosses and the cut outs are in alignment for lift up removal of the cap from the collar ring.

Corresponding bosses and cut outs have different lengths and depths. In some embodiments, the dimensions of corresponding bosses and cut outs are the same while, in other embodiments having an interference fit between the cap and collar ring, the depths of the bosses are greater than the depths of the corresponding cut outs.

BRIEF DESCRIPTION OF THE DRAWINGS

The present invention will be more fully understood when the specification herein is taken in conjunction with the drawings appended hereto, wherein.

DETAILED DESCRIPTION OF THE INVENTION

Figure 1:
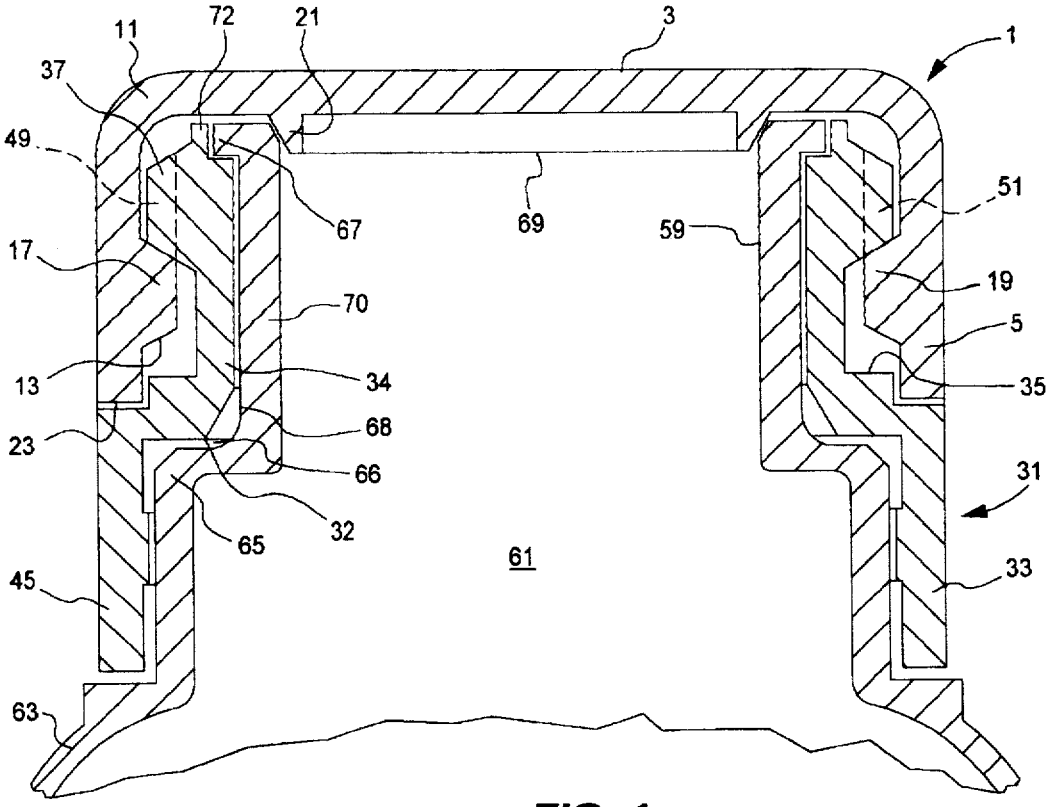
FIG. 1 shows a front cut view of present invention cap and collar ring attached to a container.

The present invention is a container closure device. It includes a container with at least one retainer track, a collar ring and an inner cap. The container has a top portion with a circular horizontal retainer track thereon for attachment of the collar ring to the container. The ring is circular with a horizonal track on its inside wall for attachment to the retainer track of the container so as to connect them in such a way as to be freely horizontally rotatable thereabout, but otherwise permanently connected to one another. The collar ring also has a top with an inwardly or outwardly biased ledge for retaining the cap and has a plurality of cut outs on the ledge to permit the cap to be inserted and removed from the collar ring. The cap has a circular bottom adapted to be inserted into or onto the ring and over the top of the container mechanism. The bottom of the cap has a plurality of bosses which correspond to and have a geometry of adequate size to freely move through the cut out of the ledge of the collar ring.

When there are two bosses and cut outs, the lengths of the first boss and first cut out are greater than the lengths of the second boss and the second cut out and the widths of the first boss and the first cutout are less than the widths of the second boss and the second cutout. In this way, there is no smaller boss that can slip through the larger cut out, thereby preventing opening in a non fire position.

When there are three bosses and cut outs, a first boss and a first cut out have lengths which are greater than lengths of a second boss and a second cut out. The lengths of the second boss and the second cut are greater than lengths of a third boss and a third cut. The third boss and the third cut out have depths which are greater than depths of the first boss and the first cut out, and depths of the second boss and the second cut out. The depths of the first boss and the first cut out are less than the depths of the second boss and the second cut out. In this way, no smaller boss can slip through a larger cut out.

When the cap is inserted and rotated, both the cap and the ring move together due to intentional friction caused by the tight fit between the cap and ring. In preferred embodiments, the surface of the cap which contacts the ring and/or the surface of the ring which contacts the cap is intentionally formed with non-smooth surfaces such as rough surface molding, cross-hatch surface molding or shallow serration molding. In order to remove the cap, the ring and cap must be rotated relative to one another so that the bosses are aligned with the cut outs. In preferred embodiments, the ledge of the ring has adequate flexibility to allow the cap to be pushed down without alignment of the bosses and the cut out, but not to be removed unless alignment is first provided.

In another embodiment, an outer edge of each boss extends beyond each corresponding cut out. Thus, the boss is made deeper than the cut out and causes an interference fit so that the cap and bottom ring must be pried apart even though corresponding bosses and cut outs are aligned.

Figure 3:
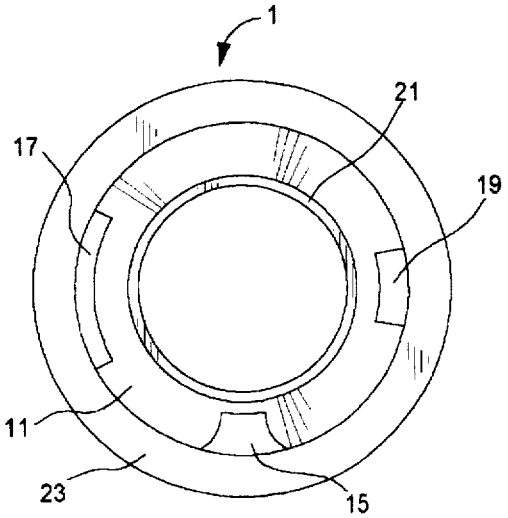
FIGS. 2 and 3 show a perspective bottom view and a bottom view, respectively, of the cap shown in FIG. 1.
Figure 2:
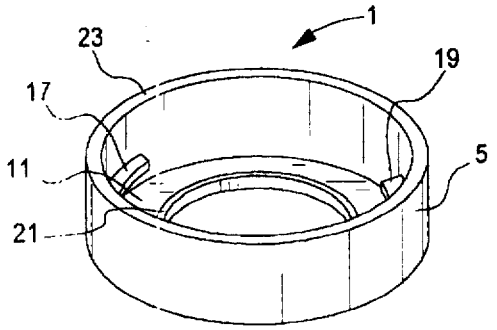

FIG. 1 shows a front cut view of present invention cap 1 and collar ring 31 attached to a container 61. FIG. 2 shows a perspective bottom view of the cap 1 and FIG. 3 shows a bottom view thereof.

As can be seen, cap 1 includes a top portion 3 and a sidewall 5 with an open bottom 23. Cap 1 further includes an annular projection 21 from an underside of top 3 to allow for a plug seal or other seal for conventional medicine cap-type seal. There is a shoulder 11 which will be discussed in more detail hereinafter and a ledge 23.

Additionally, there are shown three different bosses 15, 17, and 19. Boss 17 has a tapered bottom 13 as do the other bosses to allow cap 1 to be easily snapped onto collar ring 31 but not easily removed therefrom. This would be typical of one type of boss in preferred embodiments of the present invention.

Figure 5:
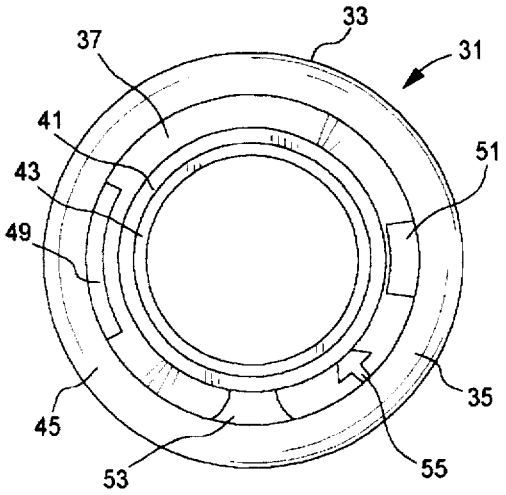
FIGS. 4 and 5 show a perspective view and a top view, respectively, of the collar ring shown in FIG. 1.
Figure 4:
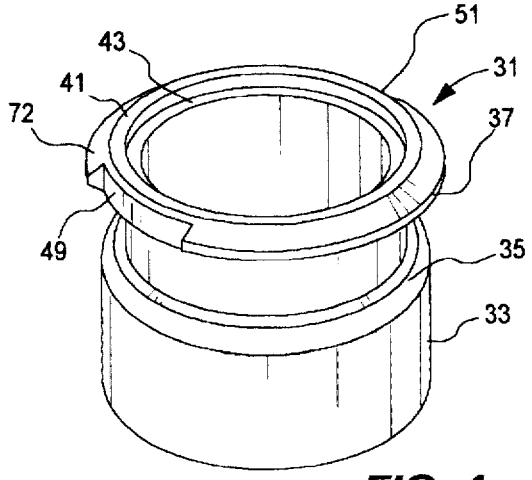

Referring now to FIGS. 4 and 5 there are shown a perspective View and a top view, respectively, of collar ring 31. Collar ring 31 includes side wall 33 and shoulder 35, as well as a ledge 37. This ledge 37 acts in conjunction with shoulder 35 to frictionally lock with the ledges of cap 1. Also, top rim 41 of collar ring 3 seals with the annular projection 21 of top 3 of cap 1. Further, as can be seen from the perspective view in FIG. 4, shoulder 35 protrudes beyond ledge 37 and this enables frictional contact with cap 1, as well as non-removable but rotational attachment to a container. It is the combination of ledge 41, protrusion 34 and underside 32 which constitutes a horizontal track within collar ring 31 for attachment to container 61 as described below. There is a plurality of cut outs and, in this case, three cut outs 49, 51 and 53 of different sizes and arranged in a non-symmetrical manner so as to align with the bosses 15, 17, and 19 of cap 1 in only a single orientation.

As can be seen, first boss 17 and first cut out 49 have lengths which are greater than lengths of second boss 19 and second cut out 51. The lengths of the second boss 19 and the second cut 51 are greater than lengths of third boss 15 and third cut 53. The third boss 15 and the third cut 53 out have depths which are greater than depths of the first boss 17 and the first cut out 49, and depths of the second boss 19 and the second cut out 51. The depths of the first boss 17 and the first cut out 49 are less than the depths of the second boss 19 and the second cut out 51. In this way, no smaller boss can slip through a larger cut out.

Referring again to FIG. 1, container 61 includes sidewall 63 with neck 59 and protrusions 65 and 67 so as to create a horizontal track thereabout shown as track 66. While track 66 is indented on container 61 and track 34 is protruding on the inside collar ring 31, they could be reversed without exceeding the scope of the present invention. There is an open top 69 to container 61 and collar ring 31 has been snapped onto container 61 so as to be non-removably attached thereto but freely rotatable thereabout. This is because inwardly tapered portion 68 allows collar ring 31 to pass over tapered ledge 67 but flat surface 70 does not permit collar ring 31 to be removed therefrom. Thus, collar ring 31 is freely rotatable but non-removable. Cap 1 has been snapped onto collar ring 31, as shown, and due to the tapered surfaces such as tapered bottom 13 of boss 17, cap 1 can easily slide over tapered edge 72 of collar ring 31 but cannot be removed therefrom. Further, because of the tight fit between boss 17 and ledge 37, there is frictional engagement of cap 1 with collar ring 31 so that when either collar ring 31 or cap 1 is rotated, the other will rotate along with it. On the other hand, if a user holds cap 1 with one hand and holds collar ring 31 with the other hand and rotates cap 1 relative to collar ring 31, as, for example, by virtue of alignment rings such as alignment ring 55, in FIG. 5, then the bosses 15, 17 and 19 will be in alignment with cut outs 53, 49 and 51, respectively, so that cap 1 can then be lifted up and easily removed from collar ring 31. Thus, by virtue of the embodiment shown in FIGS. 1 through 5, the present invention device will be child resistant and will also be friendly to people with dexterity difficulties such as arthritics due to the ease with which the frictional engagement of the cap and collar ring may be overcome for subsequent removal of the cap. It will also prevent removal in a non fire position by having at least one dimension of each of the plurality of bosses 15, 17, and 19 and each of the plurality of cutouts 29, 51 and 53 being greater than the dimensions of the other bosses and cutouts.

The above embodiment shows the horizontal track of the container being indented, as indicated, it could be a protrusion and the inward protrusion horizontal track of the collar could likewise be reversed so as to engage one another so that the collar ring could not be removed but could be freely rotated. Likewise, the bosses on the cap could well be an indentation and the indentation created on the collar ring could be a boss, without exceeding the scope of the present invention. Also, the version shown in the above figures illustrates the cap being inserted into the collar ring by being snapped onto the outside of the collar ring. Conversely, the cap could be snapped into the inside of the collar ring without exceeding the scope of the present invention and one such embodiment is discussed below.

Figure 6:
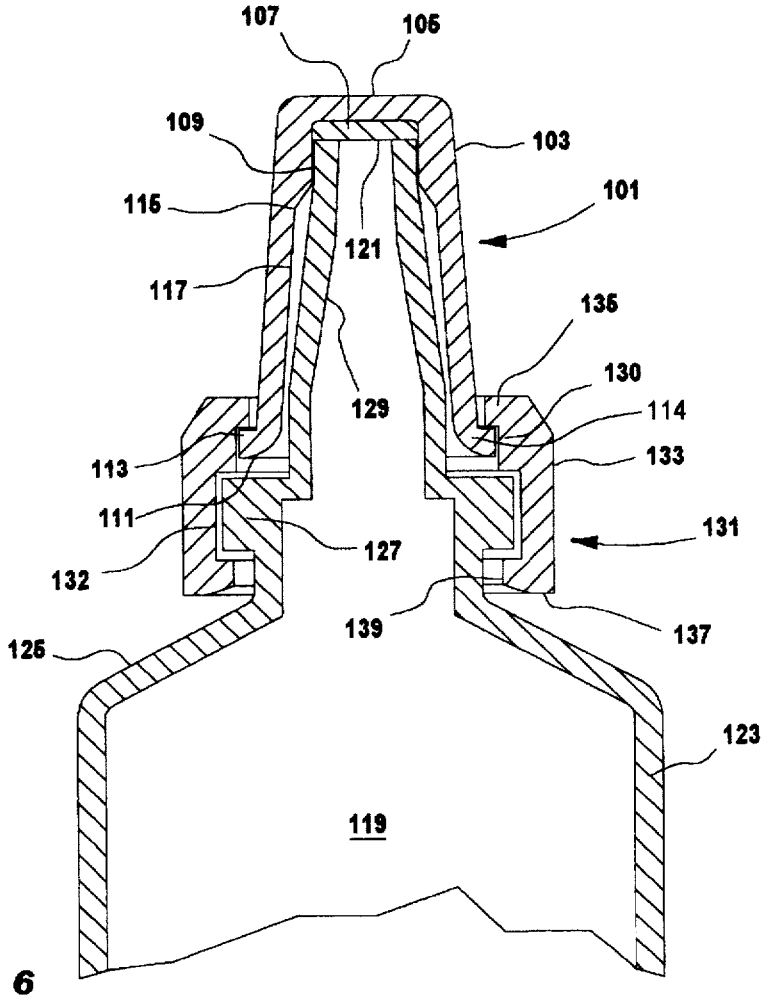
FIG. 6 shows a front cut view of an alternative embodiment cap, ring and container of a present invention device having the cap snapped into an inside of the ring.

Referring now to FIG. 6, there is shown a front cut view of an alternative embodiment present invention device which includes cap 101, collar ring 131 and container 119. Here, cap 101 includes sidewall 103 and a top 105 along with a compression seal 107 such as is conventionally used in sealed caps such as a plasticized foam or foil insert. Cap 101 has a narrow portion 109, a widening taper 115 and a wider portion 117, as shown. Additionally, at its bottom 111, there is a plurality of bosses 113 and 114, which, in this case, are biased outwardly. This fits under horizontal track 130 of collar ring 131, as shown and there will be a plurality of cut outs in ledge 135 thereof. In other words, as shown in the figure, there is an arrangement similar to that in FIG. 1 but reversed and slightly different. In this case, the container 119, with its sidewall 123, shoulder 125 and horizontal track 127 protruding outwardly, also has a tapering portion 129 and an open end top 121. The friction between the underside of ledge 135 against bosses 113 and 114 as well as the friction between top 125 and the underside of top 105 causes frictional engagement between collar ring 131 and cap 101. Horizontal track 127 of container 119 receives collar ring 131 so that horizontal track 132 of collar ring 131 is non-removably but rotatably engaged therewith. Thus, a user will separately hold collar ring 131 and cap 101 and rotate them relative to one another to align the bosses such as boss 113 with cut outs in ledge 135 for lift up removal of cap 101 from container 119 without removing collar ring 133.

Lengths of boss 113 and its corresponding cut out will be greater than lengths of boss 114 and its corresponding cut out while widths of boss 113 and its corresponding cut out will be less than widths of boss 114 and its corresponding cut out. In this way, the cap can not be removed when the cap is in a non fire position.

Figure 7:
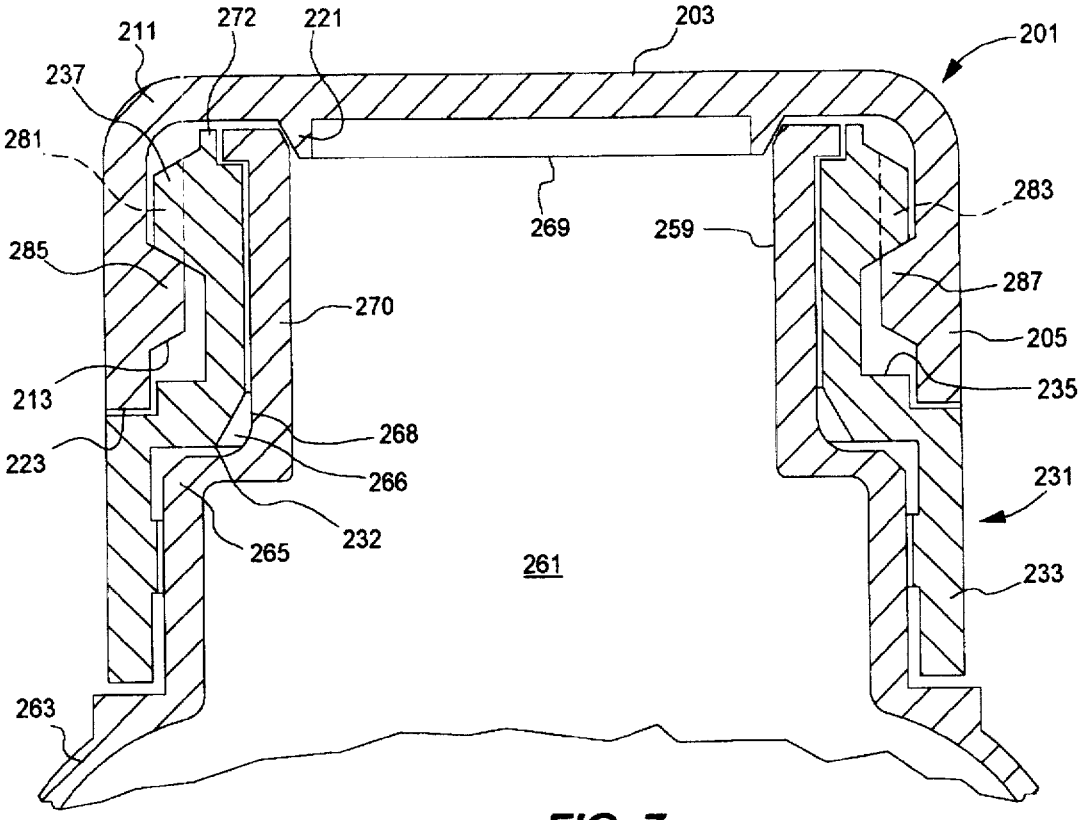
FIG. 7 shows a front cut view of an alternative embodiment cap, ring and container of a present invention device having deeper bosses and narrower cut outs.

Referring now to FIG. 7, there is shown a front cut view of an alternative embodiment present invention device which includes cap 201, collar ring 231 and container 261. This embodiment is similar to the embodiment shown in FIG. 1 with similar parts being similarly numbered but beginning with '200'.

In this embodiment the depth of each one of a plurality of bosses 285, 287 extends beyond each one of a plurality of corresponding cut outs 281, 283. Thus, each boss is made deeper than the cut out and causes an interference fit so that the cap and bottom ring must be pried apart even though corresponding bosses and cut outs are aligned.

Obviously, numerous modifications and variations of the present invention are possible in light of the above teachings. It is therefore understood that within the scope of the appended claims, the invention may be practiced otherwise than as specifically described herein.

What is claimed is:

1. A container and closure device thereof, which comprises:

(a) a container having a neck, an open top and a horizontal retainer track thereon, adapted to receive and rotatably affix a collar ring thereto;

(b) a collar ring having a circular inside wall with a horizontal track thereon for attachment to the track of said container so as to connect said collar ring to said container so as to be horizontally and freely rotatable thereabout, said collar ring also having a top with a ledge thereon for frictionally engaging and retaining a cap, said ledge having a plurality of cut outs on said ledge to permit a cap to be inserted and removed from said collar ring, said plurality of cut outs having different lengths and having different radial depths; and, (c) a snap on cap having semi-flexible walls and having a plurality of bosses which have the same radial depths and the same lengths as said plurality of cut outs so as to freely move through said plurality of cut outs of said ledge of said collar ring and to be rotatable below said ledge of said collar ring when said frictional engagement is overcome and such that when said cap is inserted and rotated, said plurality of bosses also being of adequate size and geometry to cause frictional engagement and to cause simultaneous rotation of said cap and said collar ring and to prevent removal of said cap from said collar ring, except when said cap and said collar ring are held separately and are rotated relative to one another such that said plurality of bosses and said plurality of cut outs are in alignment for lift up removal of said cap from said collar ring.

2. The device of claim 1 wherein said cap further includes an annular projection projecting from an underside of a top portion of said cap.

3. The device of claim 2 wherein said ledge of said collar ring is biased inwardly relative to said circular inside wall of said collar ring and wherein said plurality of bosses of said cap are biased outwardly relative to said semi-flexible walls of said cap, and said cap fits on the inside of said collar ring and fits over said open top and outside of at least a portion said neck of said container.

4. The device of claim 1 wherein said ledge of said collar ring has two cut outs thereon.

5. The device of claim 4 wherein one cut out has a length which is greater than a length of second cut out and said one cut out has a radial depth which is less than a radial depth of said second cut out.

6. The device of claim 5 wherein said cut outs are not directly opposite one another.

7. The device of claim 5 wherein said cut outs are directly opposite one another.

8. The device of claim 1 wherein said ledge of said collar ring has three cut outs thereon.

9. The device of claim 8 wherein a first cut out has a length which is greater than a length of a second cut out, said length of said second cut being greater than a length of a third cut out and said third cut out has a radial depth which is greater than a radial depth of said first cut out, said radial depth of said first cut out being less than a radial depth of said second cut out.

10. The device of claim 1 wherein said ledge of said collar ring is biased outwardly relative to said circular inside wall of said collar ring and wherein said plurality of bosses of said cap are biased inwardly relative to said semi-flexible walls of said cap and said cap fits on the outside of said collar ring and fits over said open top and outside of at least a portion of said neck of said container.

11. A container and closure device thereof, which comprises:

(a) a container having a neck, an open top and a horizontal retainer track thereon, adapted to receive and rotatably affix a collar ring thereto;

(b) a collar ring having a circular inside wall with a horizontal track thereon for attachment to the track of said container so as to connect said collar ring to said container so as to be horizontally and freely rotatable thereabout, said collar ring also having a top with a ledge thereon for frictionally engaging and retaining a cap, said ledge having a plurality of cut outs on said ledge to permit a cap to be interference fitted with said collar ring, said plurality of cut outs having different lengths and having different radial depths; and, (c) a snap on cap having semi-flexible walls and having a plurality of bosses which have radial depths greater than said radial depths of said plurality of cut outs and which have the same lengths as said lengths of said plurality of bosses so that said bosses can move through said cut outs as the cap wall allows for radial deflection of said greater radial depth bosses and to be rotatable below said ledge of said collar ring when said frictional engagement is overcome and such that when said cap is inserted and rotated, said plurality of bosses also being of adequate size and geometry to cause frictional engagement and to cause simultaneous rotation of said cap and said collar ring and to prevent removal of said cap from said collar ring, except when said cap and said collar ring are held separately and are rotated relative to one another such that said plurality of bosses and said plurality of cut outs are in alignment for removal by prying said cap from said collar ring.

12. The device of claim 11 wherein said cap further includes an annular projection projecting from an underside of a top portion of said cap.

13. The device of claim 12 wherein said ledge of said collar ring is biased inwardly relative to said circular inside wall of said collar ring and wherein said plurality of bosses of said cap are biased outwardly relative to said semi-flexible walls of said cap, and said cap fits on the inside of said collar ring and fits over said open top and outside of at least a portion of said neck of said container.

14. The device of claim 11 wherein said ledge of said collar ring has two cut outs thereon.

15. The device of claim 14 wherein one cut out has a length which is greater than a length of second cut out and said one cut out has a radial depth which is less than a radial depth of said second cut out.

16. The device of claim 15 wherein said cut outs are not directly opposite one another.

17. The device of claim 15 wherein said cut outs are directly opposite one another.

18. The device of claim 11 wherein said ledge of said collar ring has three cut outs thereon.

19. The device of claim 18 wherein a first cut out has a length which is greater than a length second cut out, said length of said second cut being greater than a length of a third cut out and said third cut out has a radial depth which is greater than a radial depth of said first cut out, said radial depth of said first cut out being less than a radial depth of said second cut out.

20. The device of claim 11 wherein said ledge of said collar ring is biased outwardly relative to said circular inside wall of said collar ring and wherein said plurality of bosses of said cap are biased inwardly relative to said semi-flexible walls of said cap and said cap fits on the outside of said collar ring and fits over said open top and outside of at least a portion of said neck of said container.

* * * * *